US006895859B2

(12) United States Patent
Annen et al.

(10) Patent No.: US 6,895,859 B2
(45) Date of Patent: May 24, 2005

(54) RACK-AND-PINION LOCK-UP SYSTEM FOR ATTACHING PRINT CARRIER SHEETS TO PRINT ROLLS

(75) Inventors: Cary Annen, Lake-in-the-Hills, IL (US); Roger Burton, Dagenham (GB)

(73) Assignee: Corrugated Gear & Services, Inc., Alpharetta, GA (US)

( * ) Notice: Subject to any disclaimer, the term of this patent is extended or adjusted under 35 U.S.C. 154(b) by 0 days.

(21) Appl. No.: 10/668,825

(22) Filed: Sep. 23, 2003

(65) Prior Publication Data

US 2005/0061180 A1 Mar. 24, 2005

(51) Int. Cl.[7] ..... B41F 27/12

(52) U.S. Cl. ..... 101/415.1; 101/378

(58) Field of Search ..... 101/415.1, 378, 101/382.1, 383, 409

(56) References Cited

U.S. PATENT DOCUMENTS 2,953,090 A * 9/1960 Scott ..... 101/378
6,026,746 A * 2/2000 Andaloro ..... 101/415.1

* cited by examiner

*Primary Examiner*—Leslie J. Evanisko
(74) *Attorney, Agent, or Firm*—Michael J. Mehrman; Mehrman Law Office, P.C.

(57) ABSTRACT

A low profile linear movement lock-up system that uses a rack-and-pinion gear mechanism to open and close a sliding jaw to selectively tighten and loosen a print carrier sheet on a print roll. The rack-and-pinion gear mechanism includes a sliding cam with diagonal cam slots and locking clip with pins that slide within the cam slots to open and close the jaw. The rack-and-pinion lock-up device may be configured for installation on a print roll, either in a new machine or in a retrofit application. The rack-and-pinion lock-up device may also be deployed within a print roll, or as a printing machine including a print roll with a rack-and-pinion lock-up device. An existing printing machine may be retrofitted by replacing its existing lock-up system with the rack-and-pinion lock-up system.

27 Claims, 8 Drawing Sheets

RACK-AND-PINION LOCK-UP SYSTEM FOR ATTACHING PRINT CARRIER SHEETS TO PRINT ROLLS

TECHNICAL FIELD

The present invention relates to machines for printing corrugated board and, more particularly, relates to a low profile linear movement lock-up system that uses a rack-and-pinion gear mechanism to open and close a sliding jaw to selectively tighten and loosen a print carrier sheet on a print roll.

BACKGROUND OF THE INVENTION

For many years, cylindrical print rolls have been used to print lettering and other images on sheets of corrugated board. To create the desired image, a printing die is first assembled and attached to a print carrier sheet, which is then attached to the print roll. As the print roll rotates, the printing machine applies ink to the printing die, which is transferred to the sheets of corrugated board as the sheets are conveyed through the printing machine and across the printing die. The carrier sheets are removable, so that they can be changed out for different jobs. In general, print carrier sheets carrying different dies are constructed as needed, and stored in a convenient location when not in use. Each print shop typically stores scores of printing dies for its various customers.

In a printing machine of this type, a number of different systems have been used for removably attaching the print carrier sheets to the print rolls. The Matthews Fast Lock system, for example, includes a static aluminum frame bolted into a longitudinal slot in the print roll. The frame includes two parallel longitudinal rails or clips adjacent to each other and spaced a short distance apart. The print carrier sheet includes an edge clip, commonly referred to as a "J-bar," that attaches to one of the rails. On the other end, the print carrier sheet carries a number of elastic straps that clip to the other rail of the frame.

The Matthews Fast Lock system described above, which has been widely used for many years, experiences some distinct disadvantages. First, the elastic bands inherently allow a certain amount of play in the carrier sheet attachment, which can adversely affect the consistency of the registration of the printed image on the sheet or blank being printed. Second, and more problematically, an elastic strap may occasionally break or lose a clip. The loose strap or clip may then destroy the printing die or another component of the machine, such as an expensive anilox roll. Even if the loose clip or strap does not cause damage to the printing machine or the printing die, the machine must still be shutdown in the middle of the run to remove the loose items and replace the damaged strap. Of course, shutting down the printing machine in the middle of a run is costly in terms of lost time and wasted product.

Full-wrap systems have been developed to overcome the problems associated with elastic straps described above. Full-wrap systems use print carrier sheets that wrap almost all the way around the print roll and, for this reason, do not use elastic straps or the associated clips. However, these systems have their own problems. The Inland-Annen system, for example, includes a stationary clip for attaching to an elongated J-bar on one side, just like the Matthews Fast Lock system. But for the other side of the print carrier sheet, instead of a stationary rail the Inland-Annen system includes a narrow roller inset into the print roll. This narrow roller receives a plastic strip that is typically sewn onto the other end of the full-wrap carrier sheet. A crank is turned to rotate the roller and thereby tighten the carrier sheet on the print roll. Although this system secures the print carrier sheets without the use of elastic bands, the roller system tends to crack and wear out the end of the carrier sheet that wraps around the roller due to the tight turning radius of the roller. In addition, tightly rolling the end of the carrier sheets causes the sheets to remain tightly curled after they are removed from the print roll, which makes storage difficult.

The Bobst Group has developed a full-wrap system that does not rely on a roller to tighten the print carrier sheer on the print roll. Instead of a roller, the Bobst machine includes a hydraulically operated sliding jaw system to tighten the print carrier sheer on the print roll. Although effective, this system is very expensive and difficult to install. As a result, the hydraulic jaw system is not economically feasible for many applications and, in general, is not suitable as a retrofit for an existing machine that includes a Matthews Fast Lock system.

Accordingly, there is an ongoing need for a cost effective lock-up system for attaching print carrier sheets to print rolls. There is a further need for a lock-up system that is suitable as a retrofit for an existing machine that includes a Matthews Fast Lock system.

SUMMARY OF THE INVENTION

The present invention meets the needs described above in a lock-up system that uses a rack-and-pinion mechanism to open and close a sliding jaw to selectively tighten and loosen a full-wrap print carrier sheet on a print roll. The rack-and-pinion sliding jaw system is much less expensive and easier to install than a hydraulic jaw system. In addition, the low-profile linear movement characteristics of the rack-and-pinion lock-up system allow it to be sized to fit in the same longitudinal slot used to support the older Matthews Fast Lock system. For this reason, rack-and-pinion lock-up system can be conveniently installed as a retrofit for an existing machine that includes a Matthews Fast Lock system.

The rack-and-pinion lock-up system also has the advantage of multiple cam slots spaced along a cam strip, and multiple pins spaced along the locking clip that ride in the cam slots to open and close the jaw. This configuration supports and drives the locking clip at multiple locations across the print roll, which prevents the locking clip from bending, sagging or failing. The rack-and-pinion lock-up device is also simple, inexpensive to manufacture, and easy to install and operate.

Generally described, the invention may be realized in a lock-up device for attaching a print carrier sheet to a cylindrical print roll extending in a longitudinal direction. The lock-up device includes a jaw defined by a stationary clip configured to receive a first edge clip attached to a print carrier sheet and a locking clip configured for receiving a second edge clip attached to the print carrier sheet. The lock-up device also includes a rack-and-pinion gear mechanism configured to open and close the jaw to selectively tighten and loosen the print carrier sheet on the print roll.

The rack-and-pinion gear mechanism typically includes a pinion gear and a cam strip that includes a toothed rack engaged with the pinion gear. The cam strip is configured to slide in the longitudinal direction in response to rotation of the pinion gear, and the locking clip is slidably engaged with the cam strip and configured to open and close the jaw in response to longitudinal movement of the cam strip. To allow this translation of movement, the cam strip may include one or more cam slots oriented at an angle with respect to the longitudinal direction, and the locking clip may include one or more pins slidably engaged within each cam slot. The lock-up device also typically includes a pawl for selectively locking the pinion gear in one or more selected positions, and a spring plunger for selectively holding the pawl in locked and unlocked positions.

The stationary clip, the locking clip and the cam strip may all be elongated and approximately coextensive with the print roll in the longitudinal direction. The entire lock-up device is typically configured to fit within a longitudinal slot in the print roll with the jaw substantially flush with an external surface of the print roll. More specifically, the slot may have a depth measurement of no more than approximately 5/16 inches, a width of no more than approximately 1½ inches, and the jaw may have a closing distance of at least approximately 7/16 inches. In another embodiment, the slot may have a width of no more than approximately 1⅞ inches. With these dimensions, the lock-up device conveniently fits into the slot included on print rolls having the older Matthews Fast Lock system.

When the lock-up device is attached to the print roll, the stationary clip is affixed to the print roll and configured to receive a first edge clip attached to a print carrier sheet. The locking clip is slidably supported by the print roll adjacent to the stationary clip and configured to receive a second edge clip attached to the print carrier sheet. The pinion gear is pivotally supported by the print roll, and the cam strip is supported by the print roll and configured to slide in the longitudinal direction in response to rotation of the pinion gear. As noted above, the cam strip includes a toothed rack engaged with the pinion gear and one or more cam slots oriented at an angle with respect to the longitudinal direction, and the locking clip includes one or more pins slidably engaged within each cam slot and configured to open and close the jaw in response to longitudinal movement of the cam strip.

Therefore, it will be understood that the invention may be deployed as a rack-and-pinion lock-up device configured to be installed in a print roll, either in a new machine or in a retrofit application. The invention and also be deployed as a print roll including a rack-and-pinion lock-up device, or as a printing machine including a print roll with a rack-and-pinion lock-up device. Similarly, the invention may also be practiced by retrofitting a printing machine through replacement of an existing lock-up system with a rack-and-pinion lock-up system.

In view of the foregoing, it will be appreciated that the present invention provides a cost effective lock-up system for attaching print carrier sheets to print rolls, which is suitable as a retrofit for an existing machine that includes a Matthews Fast Lock system. The specific techniques and structures for implementing the rack-and-pinion lock-up system, and thereby accomplishing the advantages described above, will become apparent from the following detailed description of the embodiments and the appended drawings and claims.

DETAILED DESCRIPTION OF THE EMBODIMENTS

Figure 1:
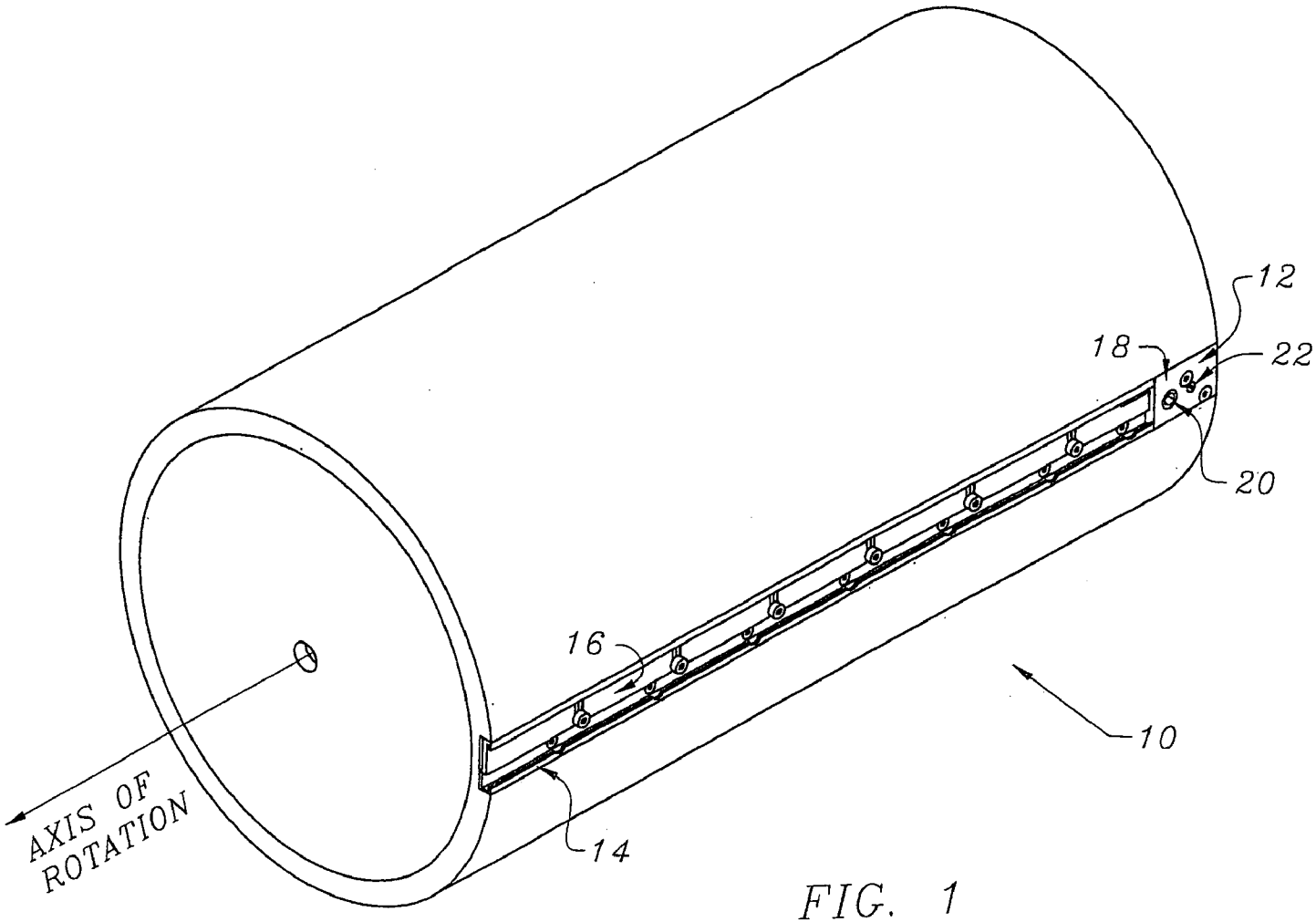
FIG. 1 is a perspective side view of a print roll with a rack-and-pinion lock-up device.

The rack-and-pinion lock-up system may be used to removably attach print carrier sheets to print rolls in any type of roller printing system, and particularly those using the anilox flexographic printing technology that has been used in the corrugated board industry for many years. The basic anilox flexographic printing technology has been deployed in a wide variety of printing machines, such as those described in commonly-owned U.S. Pat. No. 6,557,465 entitled, "Printing Machine With Dual-Ink Applicators" dated May 6, 2003, and U.S. Pat. No. 6,062,751 entitled "Belt-Driven Printer-Cutter Machine For Corrugated Paperboard of Varying Thickness" dated May 16, 2002, which are incorporated herein by reference. The rack-and-pinion lock-up system may be used to attach print carrier sheets to print rolls in these machines or in any other roller printing machine that uses print rolls and print carrier sheets. Suitable print carrier sheets for use with the rack-and-pinion lock-up system are described in the concurrently filed U.S. patent application Ser. No. 10/668,844, entitled "Print Carrier Sheet With Crimp-On Edge Clips," which is also incorporated herein by reference.

As described in detail below with reference to the figures, the rack-and-pinion sliding jaw lock-up system typically includes a stationary clip and a sliding locking clip that form a jaw for attaching a print carrier sheet to a print roll. A sliding cam strip includes a toothed rack that interfaces with a spur gear to translate rotational movement of the spur gear to longitudinal sliding movement of the cam strip. The cam strip also includes diagonal cam slots that interface with pins extending from the locking clip to translate longitudinal sliding movement of the cam strip to opening and closing movement of the locking clip. The resulting rack-and-pinion sliding jaw lock-up system has the advantage of a low-profile design that can fit into a slot previously used to house a Matthews Fast Lock system.

The stationary clip, locking clip and cam strip may be milled from steel to form an exceptionally rugged design. For a less costly alternative, one or more of these components may be constructed as an extrusion, typically from aluminum. The most cost effective design for many applications may include a stationary clip and a locking clip formed from extrusions, whereas the cam strip, which includes the toothed rack and the cam slots, may be milled from flat steel stock. The spur gear should also be milled from steel to avoid excessive wear in the components of the drive system.

In addition, the specific rack-and-pinion lock-up system described below uses a spur gear to drive a linear toothed rack to effect movement of the sliding jaw system. However, other types of gear arrangements may be employed within the rack-and-pinion system, such as a worm gear, beveled gear, or other suitable alternative type of gear operating with an appropriately configured sliding rack. In addition, the rack-and-pinion drive system may also be used to drive a jaw with hinged or pivoting connection that is not strictly limited to sliding movement. It should be understood that modifications of this sort to the specific embodiments described below fall within the definition of a rack-and-pinion lock-up system as that term is used in this specification and the appended claims. Nevertheless, it should also be appreciated that the spur gear, linear track, sliding jaw system of the particular embodiment described below is presently considered to be the most cost effective and technically sound design alternative.

More specifically, the rack-and-pinion sliding jaw lock-up system is well suited for use as a retrofit to the Matthews system, which has been widely used for many years. The rack-and-pinion sliding jaw lock-up system is also inexpensive to manufacture, rugged and durable in construction, has a minimum number of moving parts, avoids binding in the movement, avoids curling or cracking the carrier sheet, has no dangling parts that might break loose, and supports the print carrier sheet in multiple locations across print roll to prevent bending or warping of the locking clip. For these reasons, this specific embodiment is presently considered to have commercial advantages over other approaches that might be employed to accomplish an equivalent result.

Turning now to the figures, in which like numerals refer to similar elements throughout the several figures, FIG. 1 is a perspective side view of a cylindrical print roll 10 that extends in a longitudinal direction along its axis of rotation. As noted previously, this print roll may be used to carry a print carrier sheet in any type of roller printing system, such as an anilox flexographic printing machine. The print roll 10 carries a rack-and-pinion lock-up device 12 for attaching a print carrier sheet to the print roll. The lock-up device 12 includes a stationary clip 14 and locking clip 16 that can selectively slide toward and away from the stationary clip to form a jaw extending almost entirely across the print roll 10 in its longitudinal direction. A rack-and-pinion mechanism 18 can be manually operated to open and close the jaw by sliding the locking clip 16 toward and away from the stationary clip 14. To operate the rack-and-pinion mechanism, a technician places a tool, such as an Allen wrench, into a drive socket 20. Turning the wrench turns a pinion gear 60 (shown in FIG. 5), which drives the opening and closing movement of the jaw. The rack-and-pinion mechanism also includes a lock socket 22, typically operated with a screwdriver, which is used to lock the pinion gear in a desired position. As a convenience, a combination tool in an "L" shape with a properly sized Allen wrench on one end and a properly sized flat-head screwdriver on the other end may be used to operate the rack-and-pinion mechanism. This tool should be stored in a convenient location, such as attached to the end of a leash attached to the frame supporting the print roll.

Figure 2:
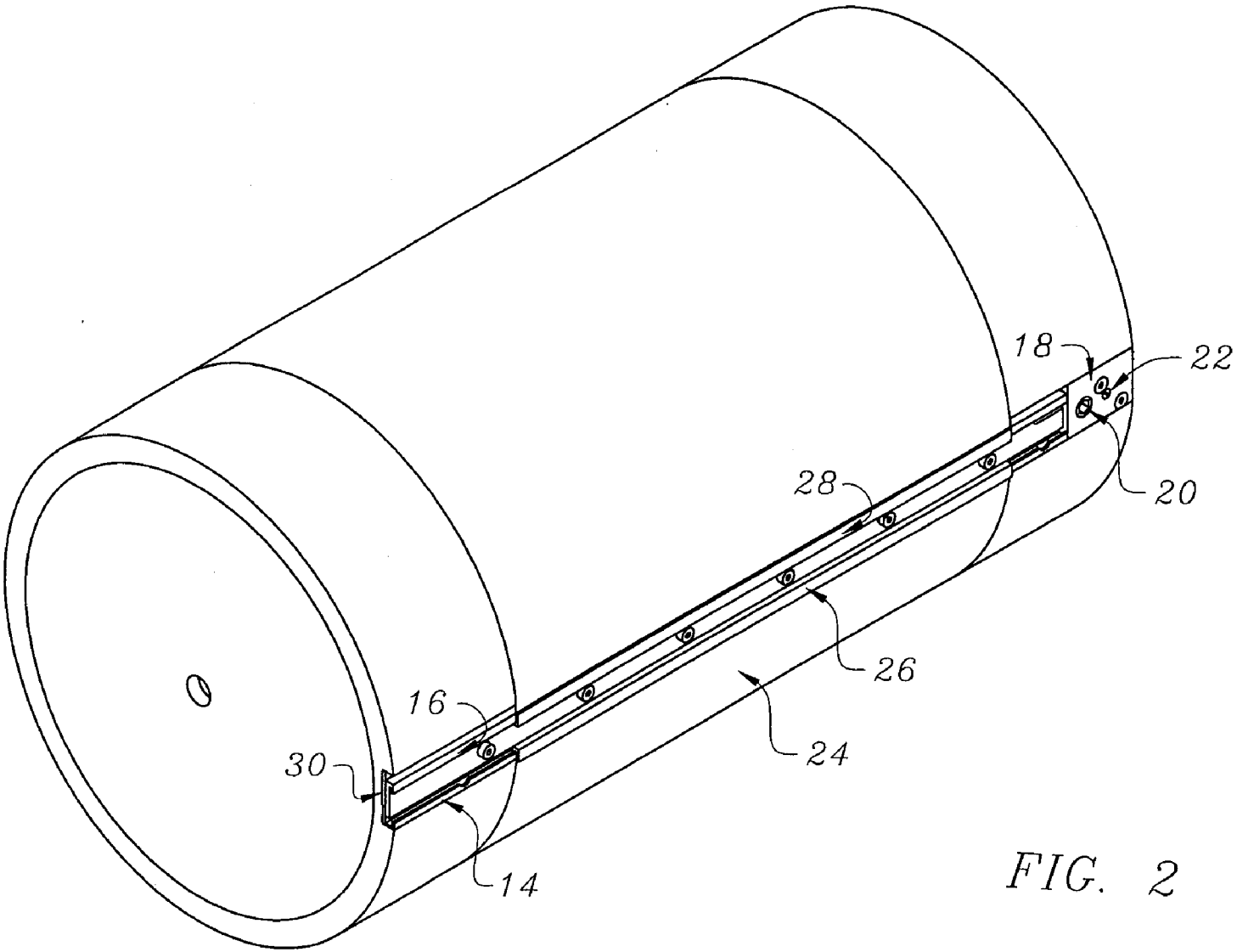
FIG. 2 is a perspective side view of a print roll with a rack-and-pinion lock-up device carrying a print carrier sheet.

FIG. 2 is a perspective side view of the print roll 10 carrying a print carrier sheet 24. To install the print carrier sheet as shown, the technician places the carrier sheet 24 on the print roll 10 with one end clip 26 (typically a J-bar) interfaced with the stationary clip 14 and a second end clip 28 interfaced with the locking clip 16. The technician then places the screwdriver tool in the lock socket 22 and turns the tool to unlock the rack-and-pinion mechanism 18. The technician then places the Allen wrench tool in the drive socket 20 and turns the tool to slide the locking clip 16 toward the stationary clip 14 until the carrier sheet 24 has been sufficiently tightened on the print roll 10. The technician then once again places the screwdriver tool in the lock socket 22 and turns the tool, this time in the opposite direction to lock the rack-and-pinion mechanism 18. The print roll is now ready to run. The process is reversed to remove the carrier sheet 24.

It should be appreciated that the resulting print carrier sheet installation process is easy, quick and involves no loose straps or clips, as was the case with the older Matthews Fast Lock system. In addition, the hand-operated lock-up system reduces the chances of injury that might occur, for example, with a hydraulic or other powered jaw system. Furthermore, the print carrier sheet 24 is supported across the full length of its attachment longitudinally across the print roll 10, which ensures a consistent registration of the print image. And the carrier sheet 24 itself is not bent or rolled in sharp manner, which avoids cracking, wearing and undesirable curling of the sheet. Importantly, all of these advantages have been achieved in a lock-up device with a minimum of moving parts, and which fits in a slot 30 in the print roll 10 sized to hold the older, static lock-up of the Matthews Fast Lock system. Therefore, the rack-and-pinion lock-up system shown in FIG. 2 can be quickly and easily installed as a retrofit for an existing Matthews Fast Lock system. To facilitate this type of retrofit application, a retrofit rack-and-pinion system may be sold with a drilling jig that includes a template to assist in proper location of the mounting holes to be drilled and tapped into the print roll. Properly sized drill bits and tapping dies may also be included to facilitate the retrofit installation.

Figure 3:
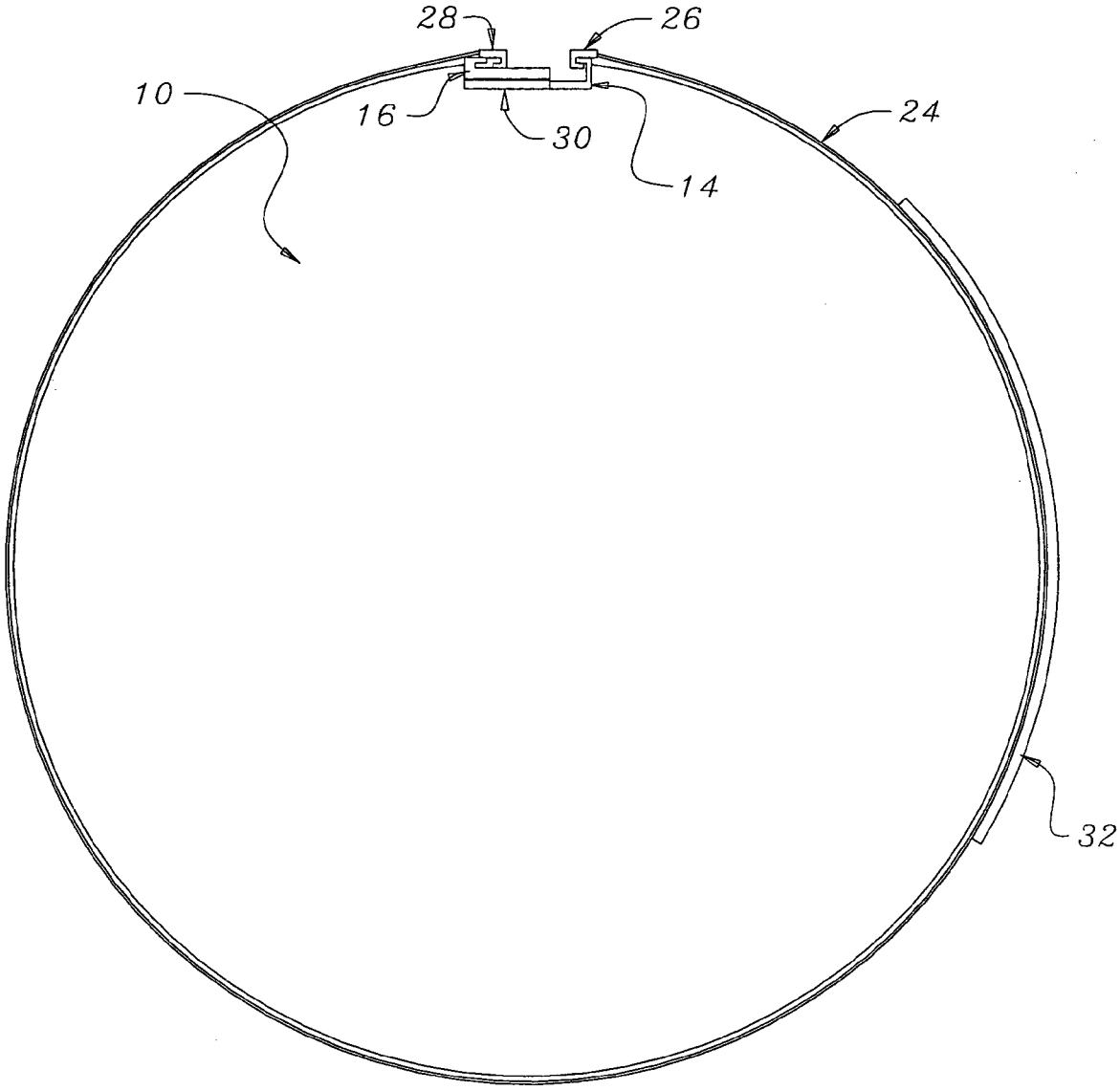
FIG. 3 is an end view of a print roll with a rack-and-pinion lock-up device carrying a print carrier sheet before the jaw has been tightened.
Figure 4:
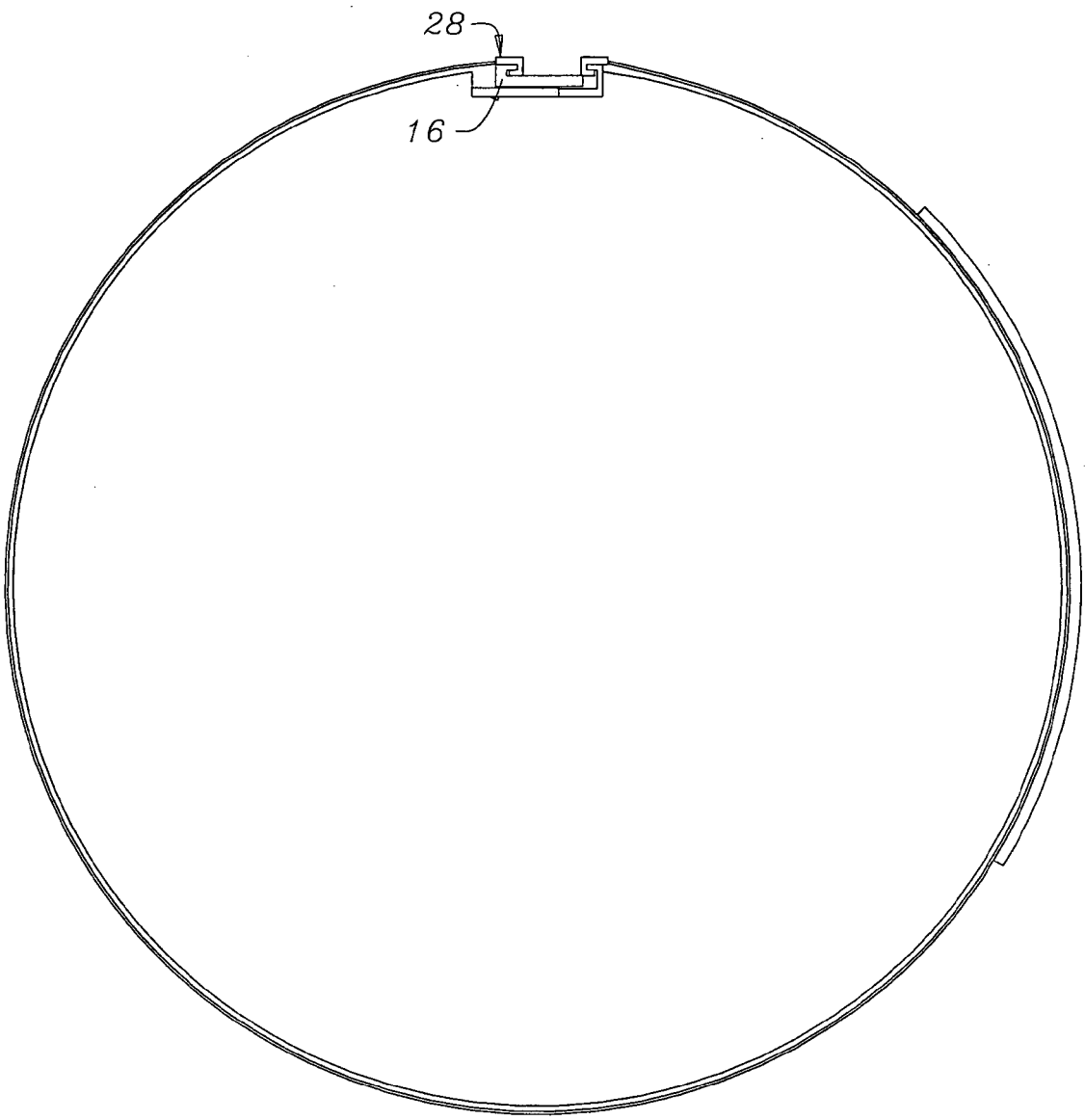
FIG. 4 is an end view of a print roll with a rack-and-pinion lock-up device carrying a print carrier sheet after the jaw has been tightened.

FIG. 3 is an end view of the print roll 10 carrying a print carrier sheet 24 before the jaw formed by the stationary clip 14 and the locking clip 16 has been tightened. This view shows the printing die 32 carried on the print carrier sheet 24, and also shows from the end how the stationary clip 14 and the locking clip 16 fit within the slot 30 in the print roll 10. The interface between the first J-bar 26 (on one end of the print carrier sheet 24) and the stationary clip 14 is shown, as well as the not-yet-tightened interface between the second J-bar 28 (on the other end of the print carrier sheet) and the locking clip 16. FIG. 4 shows the same configuration after the jaw has been tightened, with the locking clip 16 having been moved closer to the stationary clip 14 to secure the carrier sheet 24 on the print roll 10.

Figure 5:
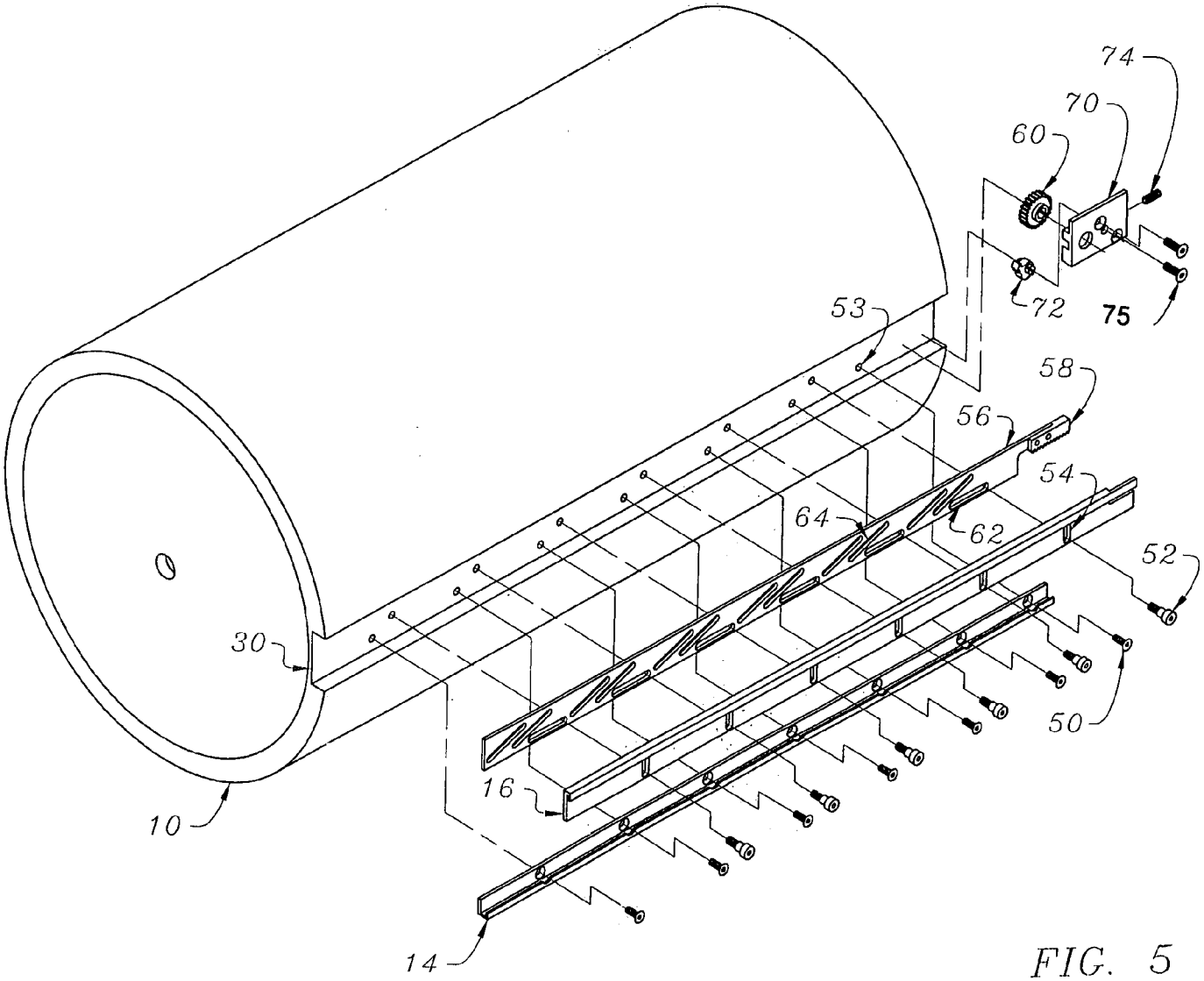
FIG. 5 is an exploded perspective side view of a print roll with a rack-and-pinion lock-up device.

FIG. 5 is an exploded perspective side view of the rack-and-pinion lock-up device. A number of countersink-head screws attach the stationary clip 14 to the print roll 10 along a first side of the slot 30 In this particular embodiment, seven similar screws are used and only one screw 50 is labeled in FIG. 5 to avoid cluttering the figure. In addition, a number of shoulder bolts slidably attach the locking clip 16 to the print roll along the opposing side of the slot 30. In this particular embodiment, six similar shoulder bolts are used, and again only one shoulder bolt 52 is labeled to avoid cluttering the figure. The shoulder bolt 52 is sized to bottom out in its corresponding hole 53 in the print roll 10 without tightening down the locking clip 16 to permit sliding movement of the locking clip after the shoulder bolt has been tightened. To permit this movement, the shoulder bolt 52 passes through a slot 54 in the locking clip 16 that extends in the direction of jaw motion sufficiently to allow the desired amount of jaw movement. In this particular embodiment, that movement and the corresponding length of the slot 54 is about seven sixteenths of an inch (7/16").

The rack-and-pinion lock-up device also includes a narrow, flat cam strip 56 that lies below the locking clip 16 and extends longitudinally the across the print roll, similar to the stationary clip 14 and the locking clip 16. The cam strip 56 includes a linear toothed rack 58 on one end that forms the "rack" portion of the rack-and-pinion drive system. A pinion gear 60 engaged with the cam strip 56 can be turned, as described previously, to slide the cam strip back and forth in the longitudinal direction. To permit this movement, the shoulder bold 52 passes through a longitudinal slot 62 in the cam strip 56 to permit longitudinal sliding movement of the cam strip after the shoulder bolt has been tightened. The slot 62 extends in the longitudinal direction sufficiently to allow the desired amount of longitudinal movement of the cam strip 56. In this particular embodiment, that movement and the corresponding length of the slot 62 is about one and one half inches (1½"). In an alternative embodiment the length of the slot 62 may about three quarters of an inch (¾"), and other lengths for the slot 62 may be selected as a matter of design choice.

Figure 6:
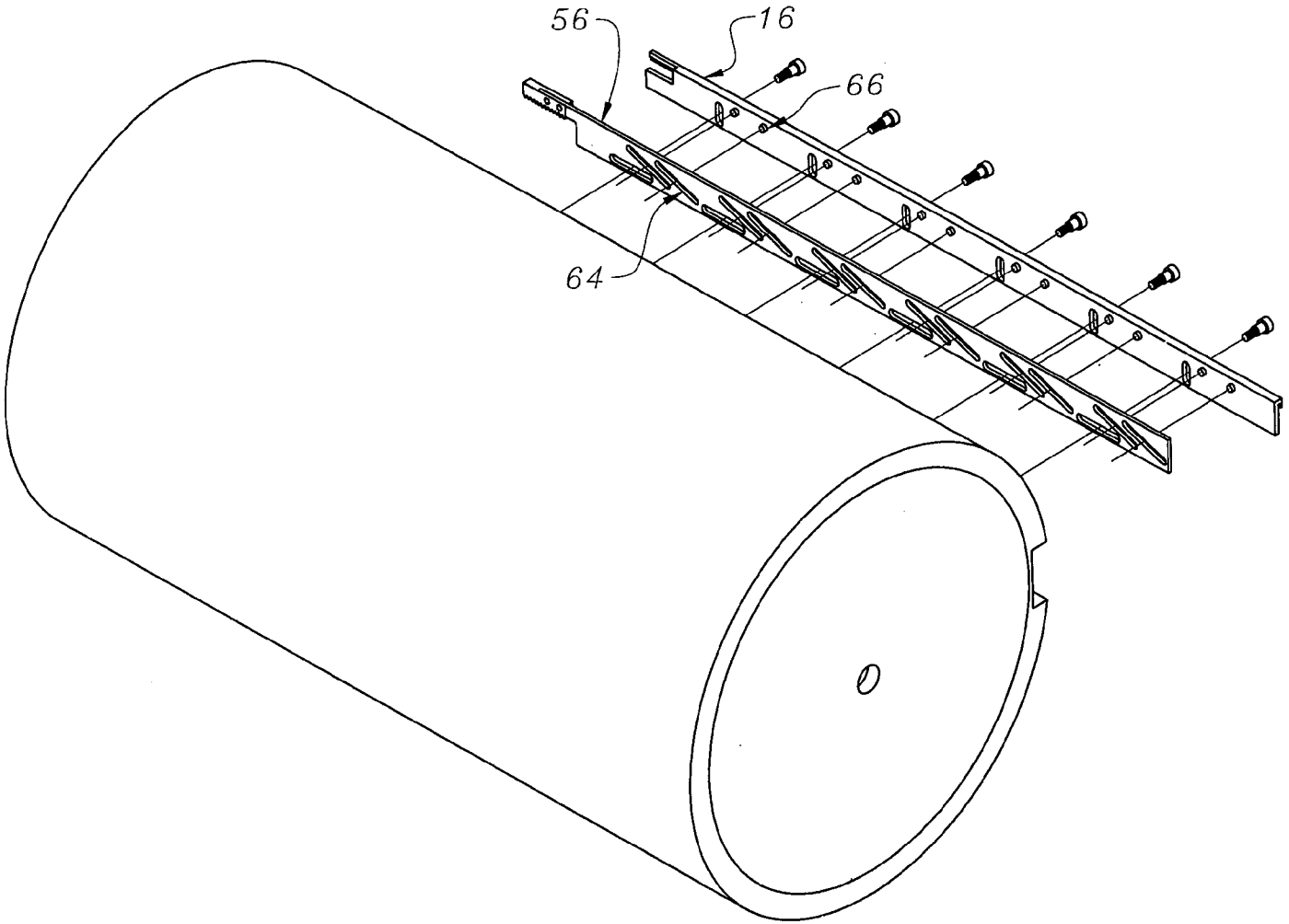
FIG. 6 is an exploded perspective side view of a print roll with a rack-and-pinion lock-up device showing the bottom sides of the cam strip and the locking clip.

FIG. 6 is an exploded perspective side view showing the bottom sides of the cam strip 56 and the locking clip 16. The underside of the locking clip 16 includes a number of pins that are slidably received within diagonal slots in the cam strip. This particular embodiment includes twelve pins and associated diagonal slots spaced along the locking clip 16 and the cam strip 56, respectively, in the longitudinal direction. Once again, only one pin 66 and one diagonal slot 64 are labeled in FIG. 6 to avoid cluttering the figure. The diagonal slot 64, which is also shown well in FIG. 5, extends in the direction of jaw motion to the same extent as the slot 54 through the locking clip 16, and also extends in the longitudinal direction to the same extent as the slot 62 through the cam strip 56. The angle of the diagonal slot 64 is typically about 27 degrees from the longitudinal, although different angles may be selected as a matter of design choice. This configuration allows the sliding interaction between pin 66 on the underside of the locking clip 16 riding in the diagonal slot 64 in the cam strip 56 to translate longitudinal sliding motion of the cam strip to sliding motion of the locking clip in the direction of jaw motion. That is, the jaw opens and closes as a result of longitudinal movement of the cam strip 56, which in turn is caused by manual rotation of the pinion gear 60.

Referring again to FIG. 5, the pinion gear 60 is held in place at one end of the print roll 10 by a housing 70, which also supports a pawl 72 and a spring plunger 74 that operates to lock and unlock the pawl. A pair of countersink-head screws holds the housing to the print roll with the pinion gear 60 engaged with the toothed rack 58 on the cam strip 56, with the pawl 72 positioned for selective pivotal engagement with the pinion gear 60, and with the spring plunger 74 positioned for selective linear engagement with the spring plunger. It will be appreciated that this rack-and-pinion mechanism has very few moving parts, and is configured for easy operation, low maintenance, and long life. It should also be appreciated that the use of multiple pins 66 and diagonal slots 64 spaced across the jaw in the longitudinal direction results in a smooth non-binding movement of the jaw that effectively eliminates the opportunity for bending of the locking clip 16 as the device is tightened. As a result, the device ensures a consistent registration of the printing die 32, does not experience significant loss of registration due to bending of the locking clip as the carrier sheet is tightened on the print roll, and will not warp over time.

Figure 7:
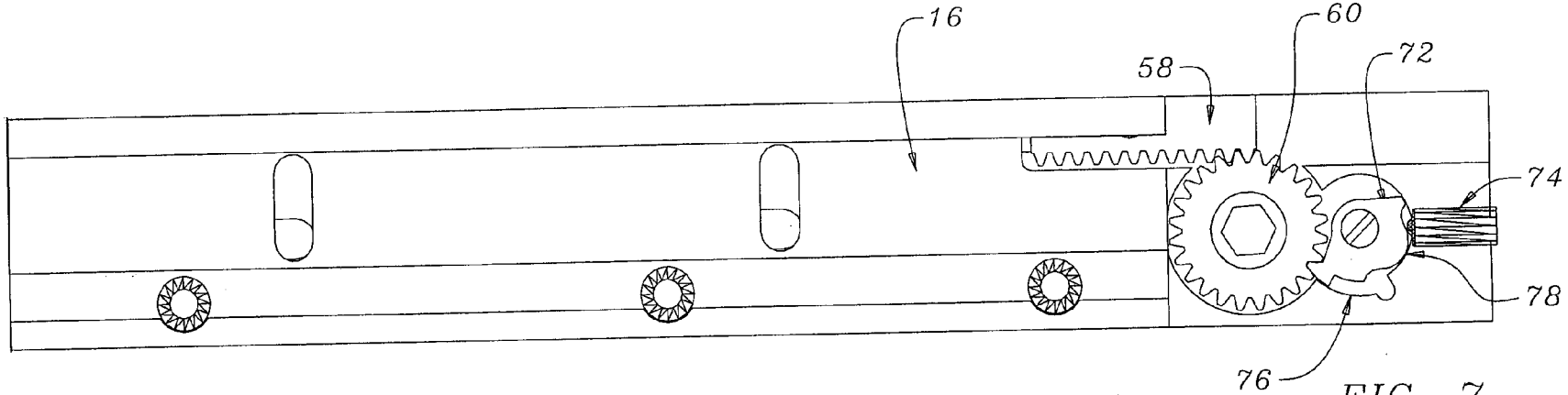
FIG. 7 is a front view of a rack-and-pinion mechanism for a lock-up device in a locked position.
Figure 8:
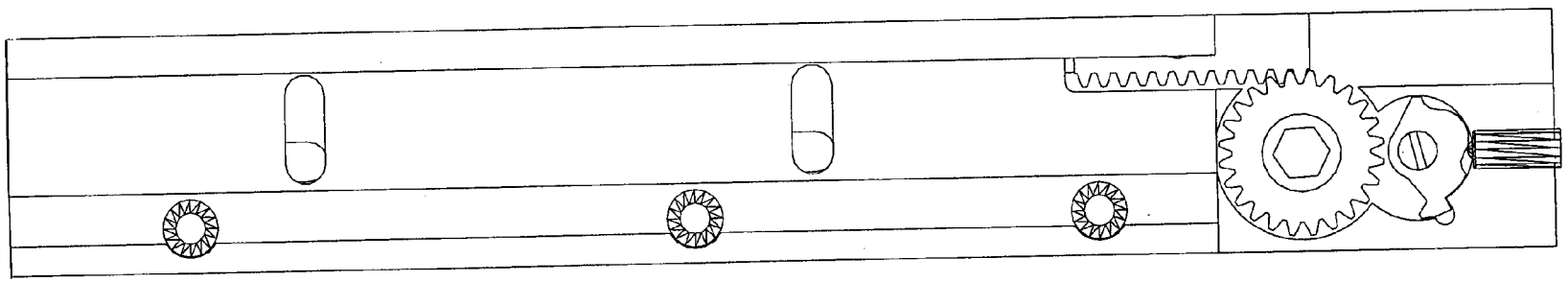
FIG. 8 is a front view of a rack-and-pinion mechanism for a lock-up device in an unlocked position.
Figure 9B:
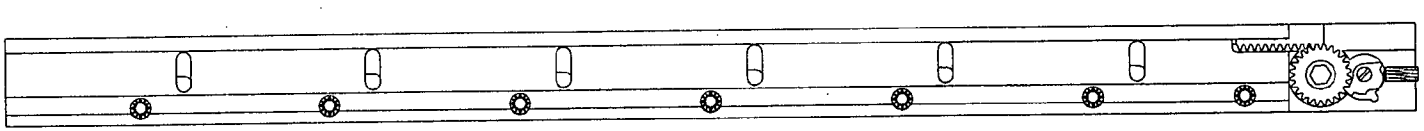
FIG. 9B as a front view of the rack-and-pinion lock-up device of FIG. 9A.
Figure 9A:
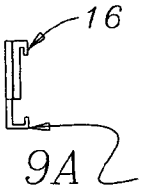
FIG. 9A as an end view of a rack-and-pinion lock-up device in a first position.
Figure 10B:
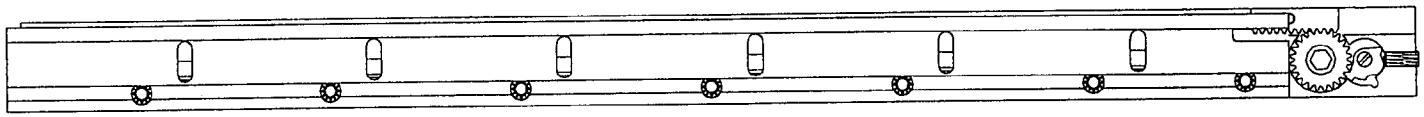
FIG. 10B as a front view of the rack-and-pinion sliding jaw lock-up device of FIG. 10A.
Figure 10A:
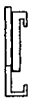
FIG. 10A as an end view of a rack-and-pinion sliding jaw lock-up device in a second position.
Figure 11B:
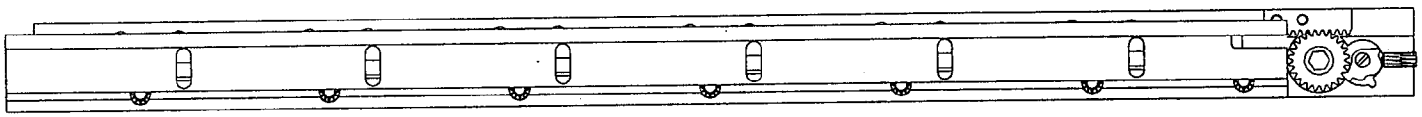
FIG. 11B as a front view of the rack-and-pinion lock-up device of FIG. 11A.
Figure 11A:
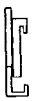
FIG. 11A as an end view of a rack-and-pinion sliding jaw lock-up device in a third position.
Figure 12B:
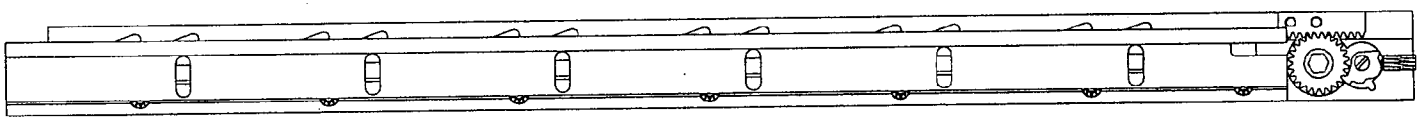
FIG. 12B as a front view of the rack-and-pinion sliding jaw lock-up device of FIG. 12A.
Figure 12A:
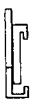
FIG. 12A as an end view of a rack-and-pinion sliding jaw lock-up device in a fourth position.
Figure 13B:
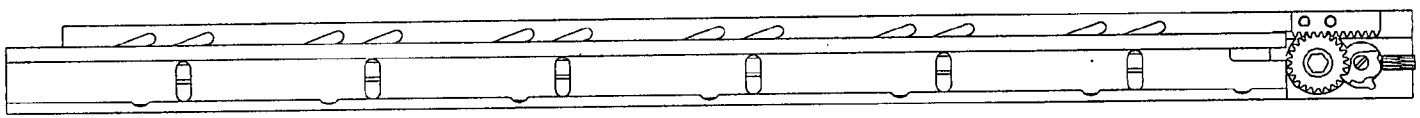
FIG. 13B as a front view of the rack-and-pinion sliding jaw lock-up device of FIG. 13A.
Figure 13A:
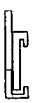
FIG. 13A as an end view of a rack-and-pinion sliding jaw lock-up device in a fifth position.

FIG. 7 is a front close-up view of the rack-and-pinion mechanism showing the configuration of the rack 58, the pinion gear 60, the pawl 72, and the spring plunger 74 in their installed configuration. FIG. 7 shows the pawl 72 in a locked position, and FIG. 8 shows the same view with the pawl 72 in an unlocked position. As shown, the pawl 72 fits into an eccentric housing 76 that restricts movement of the pawl to rotation between the locked and unlocked positions. The spring plunger 74 rides along a cam surface 78 on the pawl that selectively biases the pawl into the locked or the unlocked position, depending on which side of the cam surface the spring plunger presses against. This allows a pawl to be manually flipped between the locked and unlocked position, and to remain in a selected position until it is manually moved to the other position. The spring plunger 74 also biases the pawl 72 toward the pinion gear 60 when the spring plunger 74 is in the locked position, to permit ratcheting of the pinion gear as the gear is turned to close the jaw.

FIGS. 9A through 13A show end views of the rack-and-pinion lock-up system moving in steps from an jaw-open to a jaw-closed position. FIGS. 9B through 13B show corresponding front views of these same steps. It should be understood that the stationary clip 14 and the locking clip 16 work well and are easy to manufacture when they extend substantially all the way across the print roll in the longitudinal direction. However, it would be possible to modify this configuration to have segmented clips or clipping areas spaced across the print roll in the longitudinal direction. That is, the stationary clip 14 and the locking clip 16 need not include continuous clip edges as shown in the preferred embodiment. In addition, multiple rack-and-pinion drive mechanisms, for example one on each end of the print roll, could be used to practice the present invention. Many other design changes and alternatives for practicing the rack-and-pinion lock-up may become evident to those skilled in the art.

In particular embodiments, the length of the lock-up system typically ranges from about eighty inches (80") to about one hundred and twenty inches (120") in the longitudinal direction. The diameter of print rolls typically ranges from about eleven inches (11") to about twenty one inches (21"), with sixteen inches (16") being a fairly common design choice. The with of the lock-up system is typically one and one half inches (1½") or one and seven eights inches (1⅞") in the direction of jaw movement, and the depth is typically five sixteenths of an inch (5/16") from the outer surface toward the center of the print roll. These dimensions correspond to the standard dimensions of the Matthews Fast Lock systems, which allows the rack-and-pinion lockup system to be installed as a retrofit in the same groove in the print roll that housed the Matthews Fast Lock. The jaw movement is typically seven sixteenths of an inch (7/16"), which is sufficient to tighten properly sized print carrier sheets to the print roll and accommodated by the other dimensions of the device. The stationary clip, the locking clip and the cam strip are typically about three thirty-seconds to one eighth of an inch thick (3/32"–1/8"), so that they can lie on top of each other within the five sixteenths of an inch (5/16") overall depth of the lock-up device. As noted previously, these components may typically be manufactured as extrusions or milled from steel, as desired for particular applications.

It should be understood that the number of diagonal cam slots shown in the particular cam strip 56 illustrates a particular embodiment of the invention, and that cam strips using different numbers of cam slots may be employed. For example, the particular cam strip 56 has a repeating pattern of cam slot pairs located between longitudinal slots. However, a single cam slot located between longitudinal slots may also be employed. Of course, increasing the number of cam slots 56 and associated pins 66 increases the amount of cam surface used to move the locking strip, which reduces the amount of friction and associated wear experienced by each cam slot and associated pin. On the other hand, increasing the number of cam slot and associated pins increases complexity of the cam strip and may increase its cost. Therefore, the number of cam slot and associated pins in a particular embodiment is a design choice of the engineer in view of these and other relevant factors. The precise angel of the cam slot, which is 27 degrees from the longitudinal direction in the particular cam strip 56 shown in the illustrative embodiment, is a similar design choice.

In view of the foregoing, it will be appreciated that present invention provides significant improvements in lock-up systems for attaching carrier sheets to print rolls in roller printing systems. It should be understood that the foregoing relates only to the exemplary embodiments of the present invention, and that numerous changes may be made therein without departing from the spirit and scope of the invention as defined by the following claims.

The invention claimed is:

1. A lock-up device for attaching a print carrier sheet to a cylindrical print roll extending in a longitudinal direction, comprising:

a stationary clip configured to receive a first edge clip attached to a print carrier sheet;

a locking clip configured for receiving a second edge clip attached to the print carrier sheet; the locking clip and the stationary clip defining a jaw; and a rack-and-pinion gear mechanism configured to open and close the jaw to selectively tighten and loosen the print carrier sheet on the print roll.

2. The lock-up device of claim 1, wherein the stationary clip is elongate and approximately coextensive with the print roll in the longitudinal direction.

3. The lock-up device of claim 2, wherein the locking clip is elongate and approximately coextensive with the stationary clip in the longitudinal direction.

4. The lock-up device of claim 1, wherein the rack-and-pinion gear mechanism comprises:

a pinion gear;

a cam strip comprising a toothed rack engaged with the pinion gear;

the cam strip configured to slide in the longitudinal direction in response to rotation of the pinion gear; and the locking clip slidably engaged with the cam strip and configured to open and close the jaw in response to longitudinal movement of the cam strip.

5. The lock-up device of claim 4, wherein the stationary clip, the locking clip and the cam strip are elongate and approximately coextensive with the print roll in the longitudinal direction.

6. The lock-up device of claim 4, wherein the cam strip includes one or more cam slots oriented at an angle with respect to the longitudinal direction, and the locking clip comprises one or more pins slidably engaged within each cam slot.

7. The lock-up device of claim 4, further comprising a pawl for selectively locking the pinion gear in one or more selected positions.

8. The lock-up device of claim 7, further comprising a spring plunger for selectively holding the pawl in locked and unlocked positions.

9. The lock-up device of claim 4, configured to fit within a longitudinal slot in the print roll with the jaw substantially flush with an external surface of the print roll.

10. The lock-up device of claim 9, wherein the slot has a depth measurement of no more than approximately 5/16 inches, a width of no more than approximately 1½ inches, and the jaw has a closing distance of at least approximately 7/16 inches.

11. The lock-up device of claim 9, wherein the slot has a depth measurement of no more than approximately 5/16 inches, a width of no more than approximately 1⅞ inches, and the jaw has a closing distance of at least approximately 7/16 inches.

12. A lock-up device for attaching a print carrier sheet to a cylindrical print roll extending in a longitudinal direction, comprising:

a stationary clip configured to be affixed to the print roll and configured to receive a first edge clip attached to a print carrier sheet;

a locking clip configured to be slidably supported by the print roll adjacent to the stationary clip and configured for receiving a second edge clip attached to the print carrier sheet; the locking clip and the stationary clip defining a jaw;

a pinion gear configured to be pivotally supported by the print roll;

a cam strip comprising a toothed rack engaged with the pinion gear and one or more cam slots oriented at an angle with respect to the longitudinal direction;

the cam strip configured to be supported by the print roll and configured to slide in the longitudinal direction in response to rotation of the pinion gear; and the locking clip comprising one or more pins slidably engaged within each cam slot and configured to open and close the jaw in response to the longitudinal movement of the cam strip.

13. The lock-up device of claim 12, wherein the stationary clip, the locking clip and cam strip are elongate and approximately coextensive with the print roll in the longitudinal direction.

14. The lock-up device of claim 12, further comprising a pawl for selectively locking the pinion gear in one or more selected positions.

15. The lock-up device of claim 14, further comprising a spring plunger for selectively holding the pawl in locked and unlocked positions.

16. The lock-up device of claim 12, configured to fit within a longitudinal slot in the print roll with the jaw substantially flush with an external surface of the print roll.

17. A cylindrical print roll extending in a longitudinal direction including a lock-up device for attaching a print carrier sheet to the print roll, comprising:

a stationary clip affixed to the print roll configured to receive a first edge clip attached to the print carrier sheet;

a locking clip slidably supported by the print roll adjacent to the stationary clip and configured for receiving a second edge clip attached to the print carrier sheet; the locking clip and the stationary clip defining a jaw; and a rack-and-pinion gear mechanism configured to open and close the jaw to selectively tighten and loosen the print carrier sheet on the print roll.

18. The print roll of claim 17, further comprising a longitudinal slot in the surface of the print roll and wherein the lock-up device is configured to be received within the longitudinal slot with the jaw substantially flush with an external surface of the print roll.

19. The print roll of claim 18, wherein the stationary clip, the locking clip and cam strip of the lock-up device are elongate and approximately coextensive with the print roll in the longitudinal direction.

20. A printing machine comprising:

a cylindrical print roll extending in a longitudinal direction; and a lock-up device supported by the print roll for attaching a print carrier sheet to the print roll, the lock-up device comprising:

a stationary clip affixed to the print roll configured to receive a first edge clip attached to the print carrier sheet, a locking clip slidably supported by the print roll adjacent to the stationary clip and configured for receiving a second edge clip attached to the print carrier sheet; the locking clip and the stationary clip defining a jaw, and a rack-and-pinion gear mechanism configured to open and close the jaw to selectively tighten and loosen the print carrier sheet on the print roll.

21. The printing machine of claim 20, further comprising a longitudinal slot in the surface of the print roll and wherein the lock-up device is configured to be received within the longitudinal slot with the jaw substantially flush with an external surface of the print roll.

22. The printing machine of claim 21, wherein the stationary clip, the locking clip and cam strip are elongate and approximately coextensive with the print roll in the longitudinal direction.

23. In or for a printing machine including a cylindrical print roll extending in a longitudinal direction and a lock-up device supported by the print roll for attaching a print carrier sheet to the print roll, an improvement comprising a rack-and-pinion gear mechanism configured to open and close a jaw to selectively tighten and loosen the print carrier sheet on the print roll.

24. The printing machine of claim 23, wherein the jaw is supported within a longitudinal slot in the print roll with the jaw substantially flush with an external surface of the print roll.

25. The printing machine of claim 24, wherein the jaw is elongate and approximately coextensive with the print roll in the longitudinal direction.

26. A method for retrofitting a printing machine including a cylindrical print roll extending in a longitudinal direction and a static lock-up frame supported within a longitudinal slot in the print roll for attaching a print carrier sheet to the print roll, comprising the steps of:

removing the static lock-up frame from the slot;

providing a lock-up device configured to fit within the slot, the lock-up device comprising a rack-and-pinion gear mechanism configured to open and close a jaw to selectively tighten and loosen the print carrier sheet on the print roll; and installing the lock-up device in the slot.

27. The method of claim 26, wherein the step of providing the lock-up device comprises the steps of:

providing a stationary clip configured to receive a first edge clip attached to a print carrier sheet;

providing a locking clip slidably supported adjacent to the stationary clip and configured for receiving a second edge clip attached to the print carrier sheet; the locking clip and the stationary clip defining the jaw, and providing a rack-and-pinion gear mechanism configured to open and close the jaw to selectively tighten and loosen the print carrier sheet on the print roll.

* * * * *